US011965713B1

(12) United States Patent
Wang

(10) Patent No.: US 11,965,713 B1
(45) Date of Patent: Apr. 23, 2024

(54) SIGHTING DEVICE WITH QUICK-RELEASE ACCESSORY

(71) Applicant: Peng Wang, Yueyang (CN)

(72) Inventor: Peng Wang, Yueyang (CN)

( * ) Notice: Subject to any disclaimer, the term of this patent is extended or adjusted under 35 U.S.C. 154(b) by 0 days.

(21) Appl. No.: 18/343,191

(22) Filed: Jun. 28, 2023

(30) Foreign Application Priority Data

Jun. 7, 2023 (CN) ..... 202310667881.1

(51) Int. Cl.

| | |
|---|---|
| ***F41G 1/38*** | (2006.01) |
| ***F41G 1/32*** | (2006.01) |
| ***F41G 3/06*** | (2006.01) |
| ***F41G 11/00*** | (2006.01) |

(52) U.S. Cl.
CPC ..... *F41G 11/00* (2013.01); *F41G 1/32* (2013.01); *F41G 3/06* (2013.01); *F41G 1/38* (2013.01)

(58) Field of Classification Search
CPC ..... F41G 1/38; F41G 1/32; F41G 11/00
USPC .... 42/111, 121, 119, 120, 124, 112, 113, 84
See application file for complete search history.

(56) References Cited

U.S. PATENT DOCUMENTS 8,915,008 B2 * 12/2014 Mauricio ..... F41G 3/326 42/111
9,389,046 B2 * 7/2016 Cheng ..... F41G 1/38
10,254,084 B2 * 4/2019 Connolly ..... F41G 1/38
11,168,961 B2 * 11/2021 Sabaldan Elpedes ..... F41G 11/003

FOREIGN PATENT DOCUMENTS

GB 2617348 A * 10/2023 ..... F41G 1/32

* cited by examiner

*Primary Examiner* — Reginald S Tillman, Jr.

(57) ABSTRACT

The present disclosure discloses a sighting device with a quick-release accessory, includes a sighting module housing and an accessory housing. The sighting module housing wherein a first connector is arranged on one side of the sighting module housing, and a first electrical connection portion is arranged on one side of the first connector facing away from the sighting module housing; and an accessory housing, wherein a second connector is arranged on one side of the accessory housing; the second connector is detachably connected to the first connector, so that the accessory housing is connected to the sighting module housing; a second electrical connection portion is arranged on one side of the second connector facing away from the accessory housing; and the second electrical connection portion is electrically connected to the first electrical connection portion.

18 Claims, 8 Drawing Sheets

SIGHTING DEVICE WITH QUICK-RELEASE ACCESSORY

CROSS-REFERENCE TO RELATED APPLICATIONS

The application claims priority of Chinese patent application CN202310667881.1 filed on Jun. 7, 2023, which is incorporated herein by reference in its entireties.

TECHNICAL FIELD

The present disclosure relates to the technical field of sighting devices, and in particular, to a sighting device with a quick-release accessory.

BACKGROUND

A sighting device, as an auxiliary aiming tool, is widely configured to observe terrains, reconnoitre enemy situations, roughly measure a direction angle, elevation, a deviation of a point of impact, and the like of nighttime objects, and plays an important role in daily life and military activities.

With the increasing demand, a sighting device also has various functions. People usually add different lens accessories to a sighting device main body. For example, during night use of a sighting device, a night-vision device accessory would be usually added. To measure a distance, a range finder accessory would be usually added, or to supplement light, a light supplementing device is added. At present, only one or two kinds of lens accessories are usually added on products on the market usually, and other lens accessories cannot be replaced.

For this purpose, the present disclosure provides a sighting device with a quick-release accessory, which can effectively solve the above problems. The sighting device has a simple structure, convenient assembling and disassembling, and can achieve quick replacement.

SUMMARY

In order to overcome the shortcomings of the prior art, the present disclosure provides a sighting device with a quick-release accessory, which has a simple structure, convenient assembling and disassembling.

The technical solution adopted by the present disclosure to solve the technical problem is as follows.

The present disclosure discloses a sighting device with a quick-release accessory including: a sighting module having a sighting module housing, wherein a first connector is arranged on one side of the sighting module housing, and a first electrical connection portion is arranged on one side of the first connector facing away from the sighting module housing; and an accessory housing, wherein a second connector is arranged on one side of the accessory housing; the second connector is detachably connected to the first connector, so that the accessory housing is connected to the sighting module housing; a second electrical connection portion is arranged on one side of the second connector facing away from the accessory housing; and the second electrical connection portion is electrically connected to the first electrical connection portion.

As the improvement of the present disclosure, the first connector is provided with a clamping slot; the second connector is provided with a clamping block; and the clamping block is clamped to the clamping slot.

As the improvement of the present disclosure, the second connector further includes two sliding rods and stop nuts; the clamping block includes a first clamping block and a second clamping block; the second clamping block is provided with threaded holes; a first end of each sliding rod is connected to the first clamping block, and a second end of the sliding rod is provided with a thread portion; the stop nuts and the threaded holes are both in threaded connection to the thread portions; and the stop nuts abut against the second clamping block.

As the improvement of the present disclosure, the first ends of the sliding rods are fixedly provided with limiting portions; the first clamping block is provided with through holes; the through holes correspond to the threaded holes; the second ends of the sliding rods pass through the through holes and the threaded holes; and the limiting portions abut against one end of the first clamping block facing away from the second clamping block.

As the improvement of the present disclosure, the two sliding rods are symmetrically arranged on two sides of the second electrical connection portion.

As the improvement of the present disclosure, two plugging slots are further formed in one side of the first connector facing away from the sighting module housing; the two plugging slots are symmetrically arranged on two sides of the first electrical connection portion; the plugging slots correspond to rod bodies; and the plugging slots are configured to accommodate the rod bodies.

As the improvement of the present disclosure, an abutment platform is convexly arranged at an edge of the first electrical connection portion; an abutment surface is arranged at an edge of the second electrical connection portion; the abutment platform abuts against the abutment surface; an accommodating space is formed between an inner wall of the abutment platform and the abutment surface; and the accommodating space is configured to hermetically accommodate the first electrical connection portion and the second electrical connection portion.

As the improvement of the present disclosure, the sighting module housing is provided with a first accommodating cavity; a first control circuit board is arranged in the first accommodating cavity; and the first electrical connection portion is electrically connected to the first control circuit board.

As the improvement of the present disclosure, the accessory housing is provided with a second accommodating cavity; a second control circuit board is arranged in the second accommodating cavity; and the second electrical connection portion is electrically connected to the second control circuit board.

As the improvement of the present disclosure, the sighting device further includes a button, a button hole is formed in a surface of the sighting module housing; the button is plugged to the button hole; and the button is configured to trigger an electrical contact connected to the first control circuit board.

As the improvement of the present disclosure, the accessory includes a night-vision device.

As the improvement of the present disclosure, the accessory includes a distance measuring equipment.

The present disclosure also discloses sighting module of a sighting device including a sighting module housing, wherein a first connector is arranged on one side of the sighting module housing, and a first electrical connection portion is arranged on the first connector, the first connector is configured to detachably connected a second connector of an accessory, and when the first connector is connected to the second connector, the first electrical connection portion is electrically connected to a second electrical connection portion of the accessory.

The present disclosure also discloses an accessory of a sighting device including an accessory housing, wherein a second connector is arranged on one side of the accessory housing; the second connector is configured to detachably connect to a first connector of a sighting module, so that the accessory housing is connected to a sighting module housing of the sighting module; a second electrical connection portion is arranged on the second connector; and the second electrical connection portion is configured to electrically connect to a first electrical connection portion of the sighting device.

Beneficial effects: based on the setting of the above structure, during use, the second connector is connected to the first connector, so that the accessory housing is connected to the sighting module housing. Meanwhile, the second electrical connection portion is electrically connected to the first electrical connection portion, which achieves electrical connection between the accessory (such as a night-vision device or a distance measuring equipment) and the sighting module. Based on the simple structural setting, the accessory is connected to the sighting module, so that the sighting device can realize different functions by being connected to different lens accessories, improves the product suitability, and is convenient to use.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
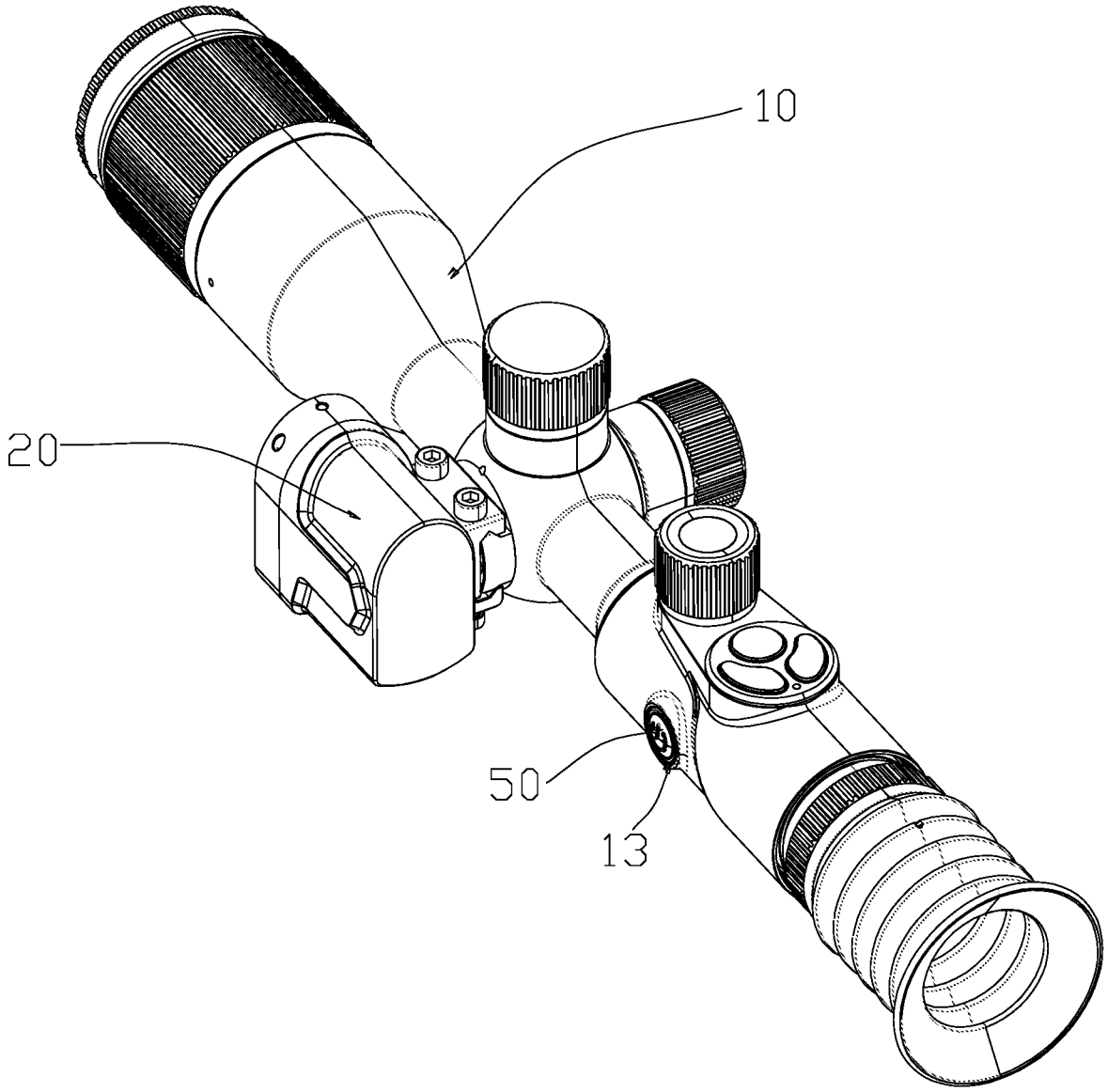
FIG. 1 is a schematic diagram of an entire structure with a first accessory according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Referring to FIG. 1 to FIG. 11, a sighting device with a quick-release accessory includes: a sighting device having a sighting module housing 10 and an accessory having an accessory housing 20. A first connector 11 is arranged on one side of the sighting module housing 10, and a first electrical connection portion 111 is arranged on one side of the first connector 11 facing away from the sighting module housing 10. A second connector 21 is arranged on one side of the accessory housing 20; the second connector 21 is detachably connected to the first connector 11, so that the accessory housing 20 is connected to the sighting module housing 10. A second electrical connection portion 211 is arranged on one side of the second connector 21 facing away from the accessory housing 20; and the second electrical connection portion 211 is electrically connected to the first electrical connection portion 111. It can be understood, the a sighting module can be an auxiliary aiming tool and is configured to observe terrains, reconnoitre enemy situations, roughly measure a direction angle, elevation, a deviation of a point of impact, and the like of nighttime objects. The accessory can be a night-vision device or a distance measuring equipment.

Based on the setting of the above structure, during use, the second connector 21 is connected to the first connector 11, so that the accessory housing 20 is connected to the sighting module housing 10. Meanwhile, the second electrical connection portion 211 is electrically connected to the first electrical connection portion 111, which achieves electrical connection between the accessory (such as a night-vision device) and the sighting module. Based on the simple structural setting, the accessory is connected to the sighting module, so that the sighting module can realize different functions by being connected to different lens accessories, improves the product suitability, and is convenient to use.

Figure 4:
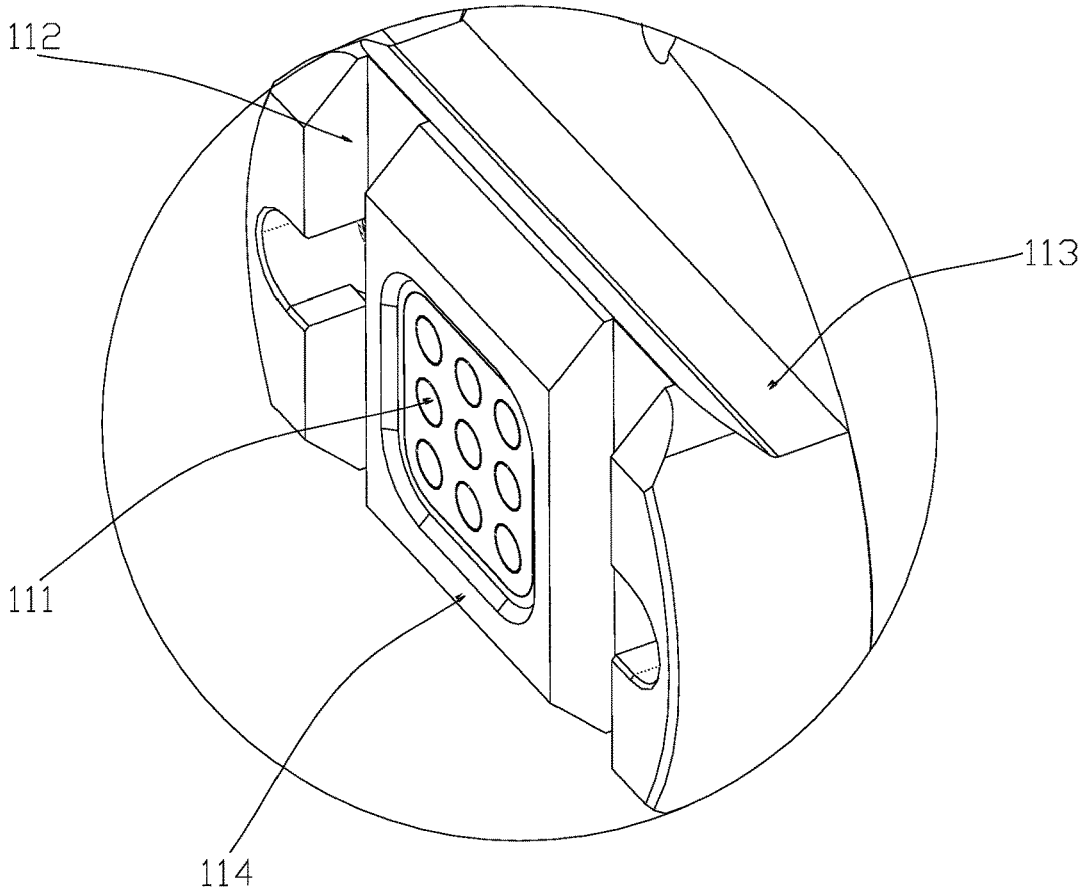
FIG. 4 is an enlarged diagram of a circle A in FIG. 3.
Figure 5:
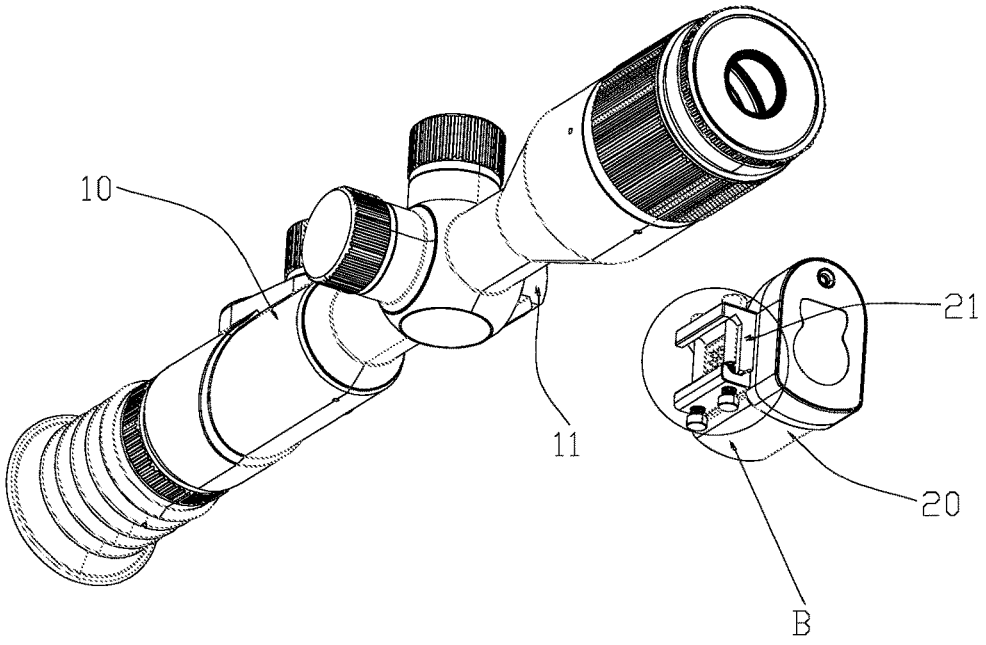
FIG. 5 is a schematic diagram of an exploded structure with a first accessory in a second view according to the present disclosure.
Figure 6:
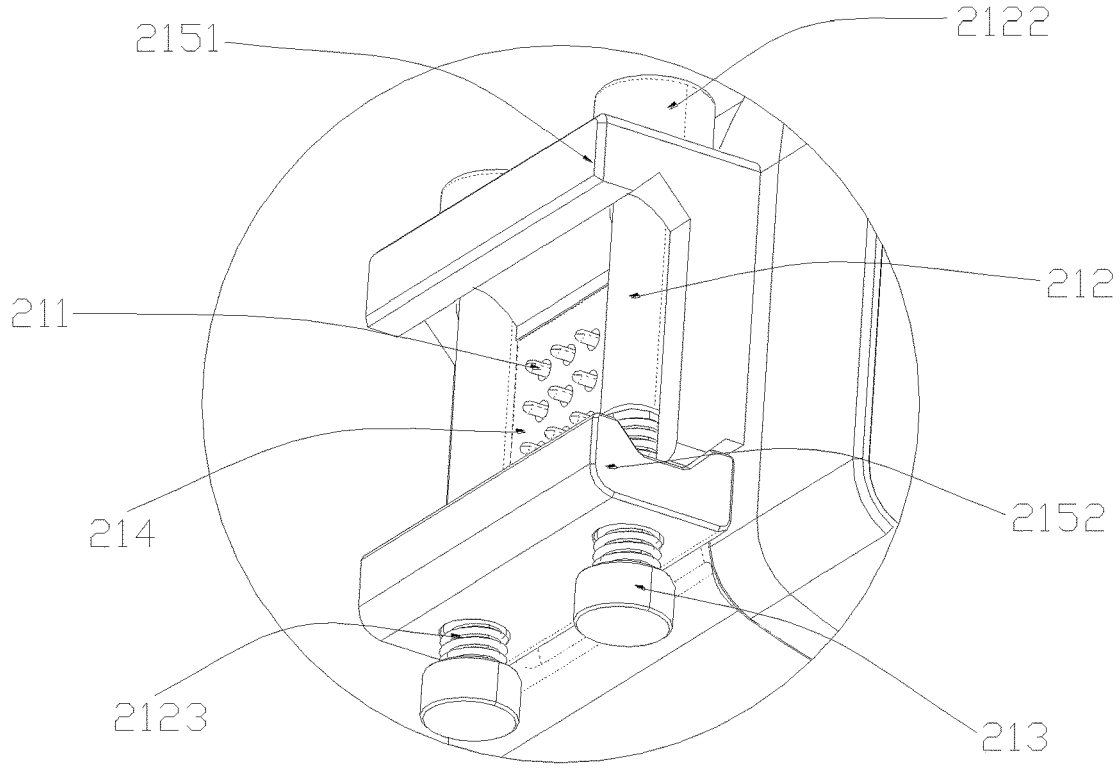
FIG. 6 is an enlarged diagram of a circle B in FIG. 5.
Figure 9:
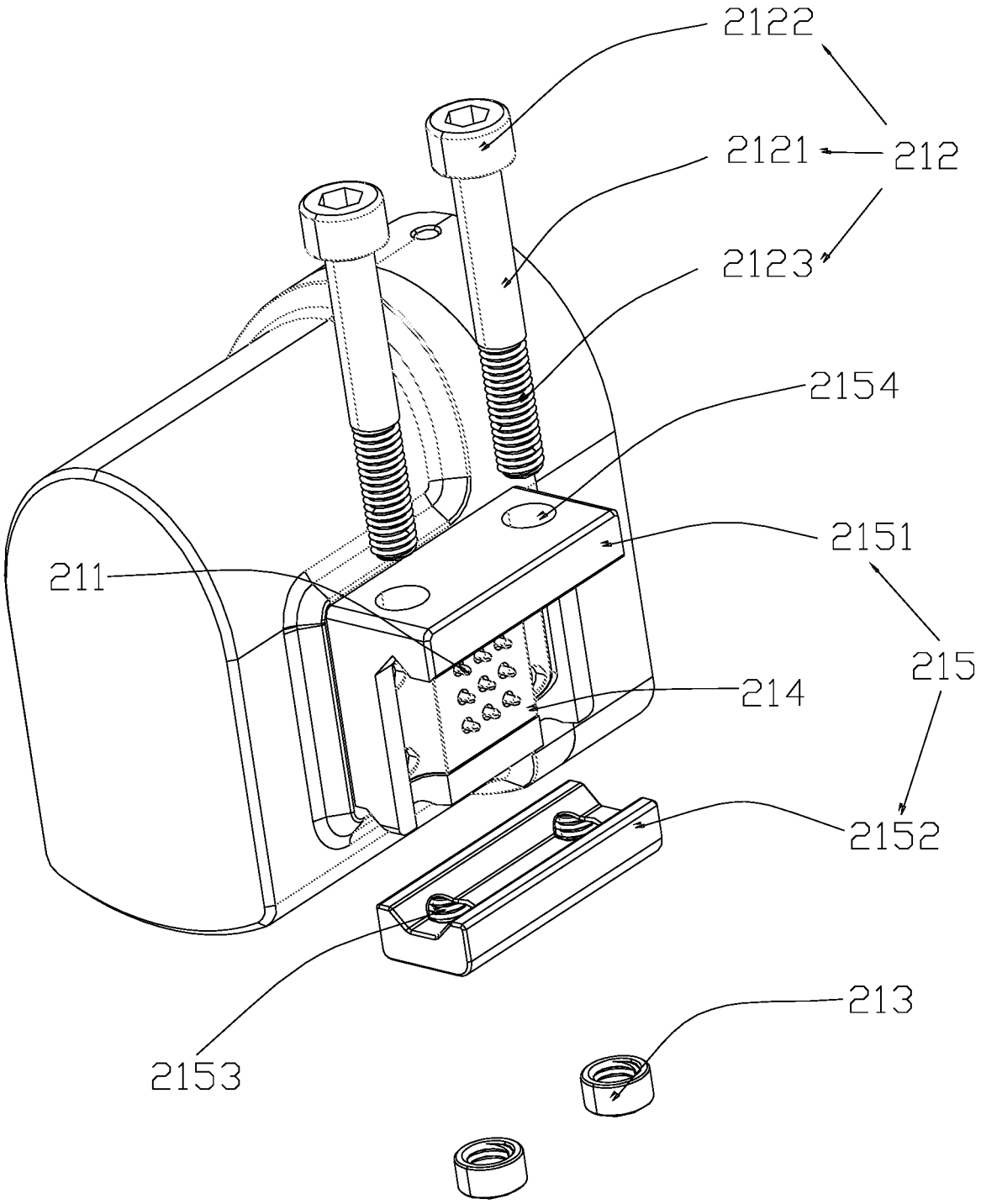
FIG. 9 is a schematic diagram of an exploded structure of a first accessory according to the present disclosure.
Figure 10:
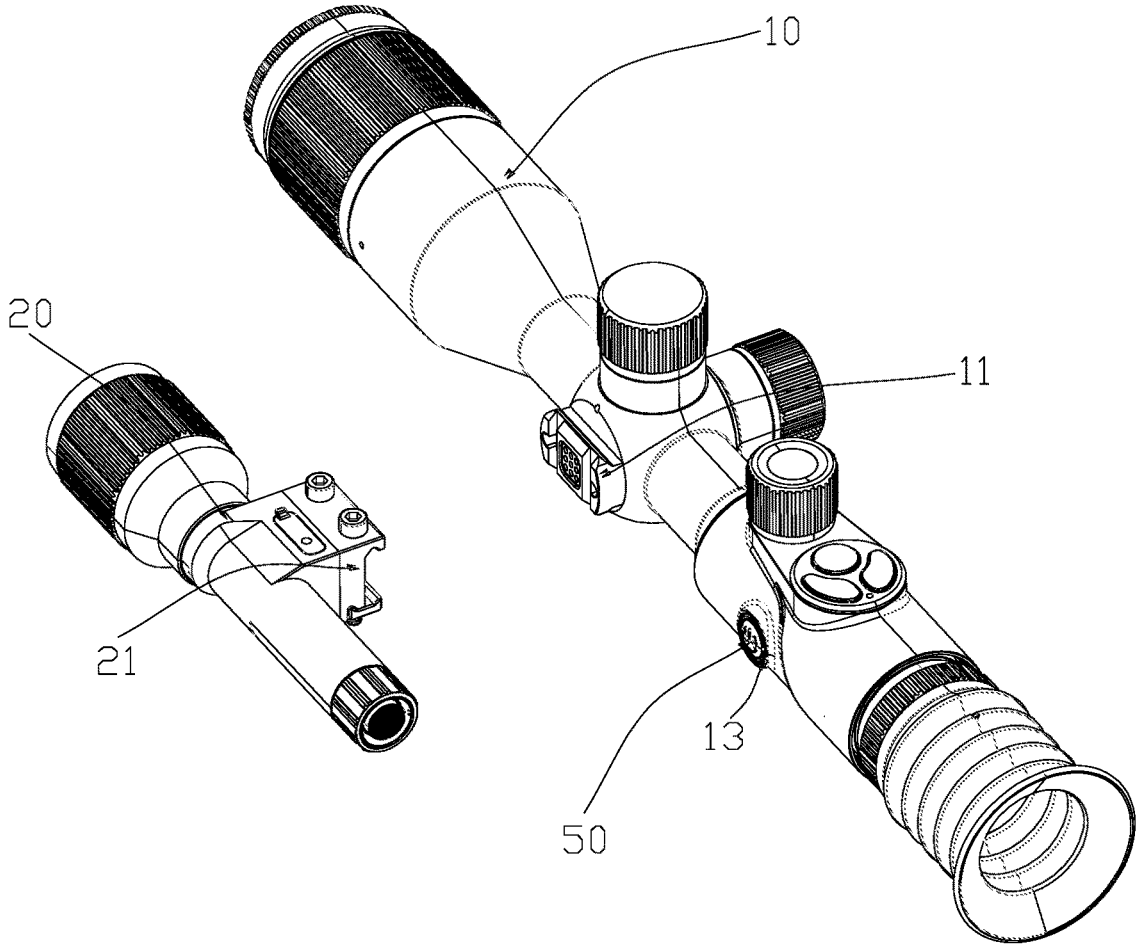
FIG. 10 is a schematic diagram of an exploded structure with a second accessory in a first view according to the present disclosure.
Figure 11:
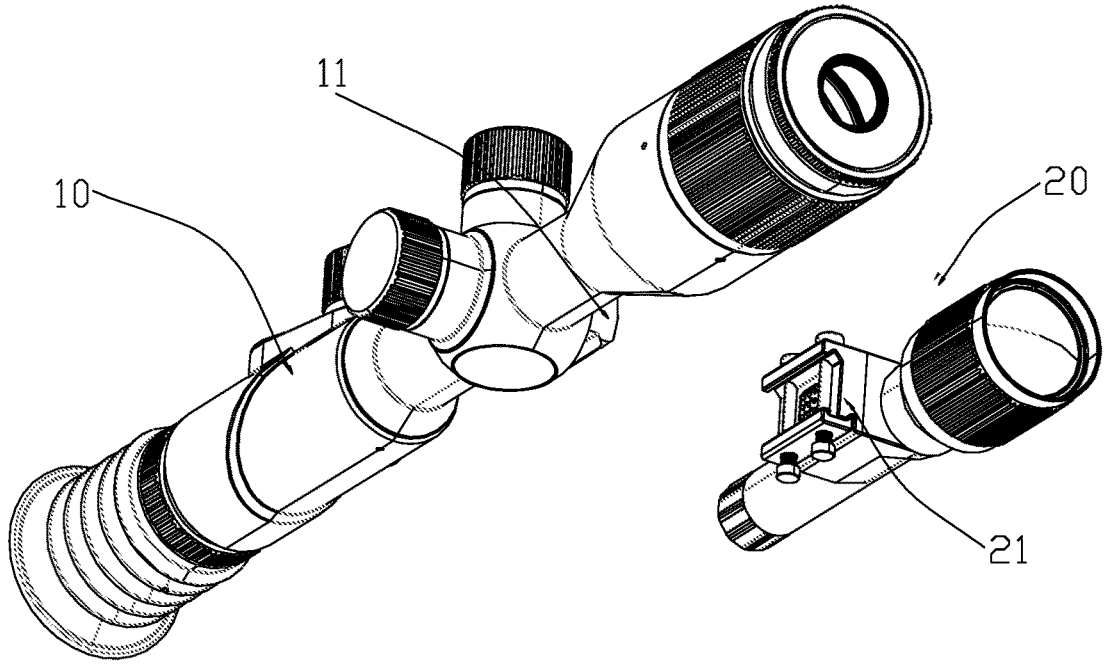
FIG. 11 is a schematic diagram of an exploded structure with a second accessory in a second view according to the present disclosure.

As shown in FIG. 4, FIG. 6, and FIG. 9, in this embodiment, the first connector 11 is provided with a clamping slot 113, and the second connector 21 is provided with a clamping block 215. The clamping block 215 is clamped to the clamping slot 113. Based on the setting of the above structure, during use, the clamping block 215 cooperates with the clamping slot 113. On the one hand, mounting and removal are facilitated, so that a user can conveniently replace the accessory; and on the other hand, the stability of a product can also be improved, so that the accessory is more stably connected to the sighting device.

As shown in FIG. 6 and FIG. 9, in this embodiment, the second connector 21 further includes two sliding rods 212 and stop nuts 213. The clamping block 215 includes a first clamping block 2151 and a second clamping block 2152. The second clamping block 2152 is provided with threaded holes 2153. A first end of each sliding rod 212 is connected to the first clamping block 2151, and a second end of the sliding rod 212 is provided with a thread portion 2123. The stop nuts 213 and the threaded holes 2153 are both in threaded connection to the thread portions 2123. The stop nuts 213 abut against the second clamping block 2152. Based on the setting of the above structure, during use, the threaded portions at the second ends of the sliding rods 212 are at least partially in threaded connection to the threaded holes 2153, and the stop nuts 213 are in threaded connection to tail ends of the threaded portions. The stop nuts 213 are screwed to move along the sliding rods 212, which can adjust a distance between the first clamping block 2151 and the second clamping block 2152, and abut against a surface of the second clamping block 2152, which can effectively limit the second clamping block 2152, to prevent the second clamping block 2152 from being separated from the sliding rods 212, so that the first clamping block 2151 and the second clamping block 2152 can be stably clamped into the clamping slot 113, and the stability of the product can be improved. Furthermore, the threaded portions are in threaded connection to the threaded holes 2153, so that the second clamping block 2152 can be stably connected to the sliding rods to fix the distance between the first clamping block 2151 and the second clamping block 2152, and the first clamping block 2151 and the second clamping block 2152 are stably clamped to the clamping slot 113.

As shown in FIG. 6 and FIG. 9, in this embodiment, the first ends of the sliding rods 212 are fixedly provided with limiting portions 2122. The first clamping block 2151 is provided with through holes 2154. The through holes 2154 correspond to the threaded holes 2153. The second ends of the sliding rods 212 pass through the through holes 2154. The threaded portions 2123 are in threaded connection to the threaded holes 2153. The limiting portions 2122 abut against one end of the first clamping block 2151 facing away from the second clamping block 2152. Based on the setting of the above structure, the first ends of the sliding rods 212 are provided with the limiting portions 2122 which can cooperate with the through holes 2154 in the first clamping block 2151 to facilitate mounting by the user. Specifically, during mounting, the second ends of the sliding rods 212 pass through the through holes 2154; the limiting portions 2122 abut against the first clamping block 2151; the threaded portions are in threaded connection to the threaded holes 2153 and the stop nuts 213; and the stop nuts 213 abut against the second clamping block 2152, so that the first clamping block 2151 and the second clamping block 2152 can be effectively fixed, and the stability of the product can be improved. The stop nuts 213 move along the sliding rods 212, which can adjust a distance between the first clamping block 2151 and the second clamping block 2152, and abut against a surface of the second clamping block 2152, which can effectively limit the second clamping block 2152, to prevent the second clamping block 2152 from being separated from the sliding rods 212, so that the first clamping block 2151 and the second clamping block 2152 can be stably clamped into the clamping slot 113, and the stability of the product can be improved.

As shown in FIG. 6, in this embodiment, the two sliding rods 212 are symmetrically arranged on two sides of the second electrical connection portion 211. Based on the setting of the above structure, during use, due to the two sliding rods 212 symmetrically arranged on the two sides of the second electrical connection portion 211 so that the stability of the product can be improved, and the second clamping block 2152 can only slide in a direction where the sliding rods 212 are located, to prevent offset.

As shown in FIG. 4, in this embodiment, two plugging slots 112 are further formed in one side of the first connector 11 facing away from the sighting module housing 10. The two plugging slots 112 are symmetrically arranged on two sides of the first electrical connection portion 111. The plugging slots 112 correspond to rod bodies 2121, and the plugging slots 112 are configured to accommodate the rod bodies 2121. Based on the setting of the above structure, during use, the first clamping block 2151 and the second clamping block 2152 are respectively clamped to the upper and lower clamping slots of the first connector 11. At this time, the second electrical connection portion 211 is electrically connected to the first electrical connection portion 111. Rod bodies of the two sliding rods 212 can be accommodated in the plugging slots 112. On the one hand, the stability of connection between the first connector 11 and the second connector 21 can be further improved, and a direct contact area between the first connector 11 and the second connector 21 can be enlarged. On the other hand, positioning and guide effects can also be achieved. When the rod bodies of the sliding rods 212 are accommodated in the plugging slots 112, it means that the accessory is mounted to the sighting device according to a right method, which can prevent a damage to the product caused by mis-installation by the user and improve the use experience of the user.

Figure 8:
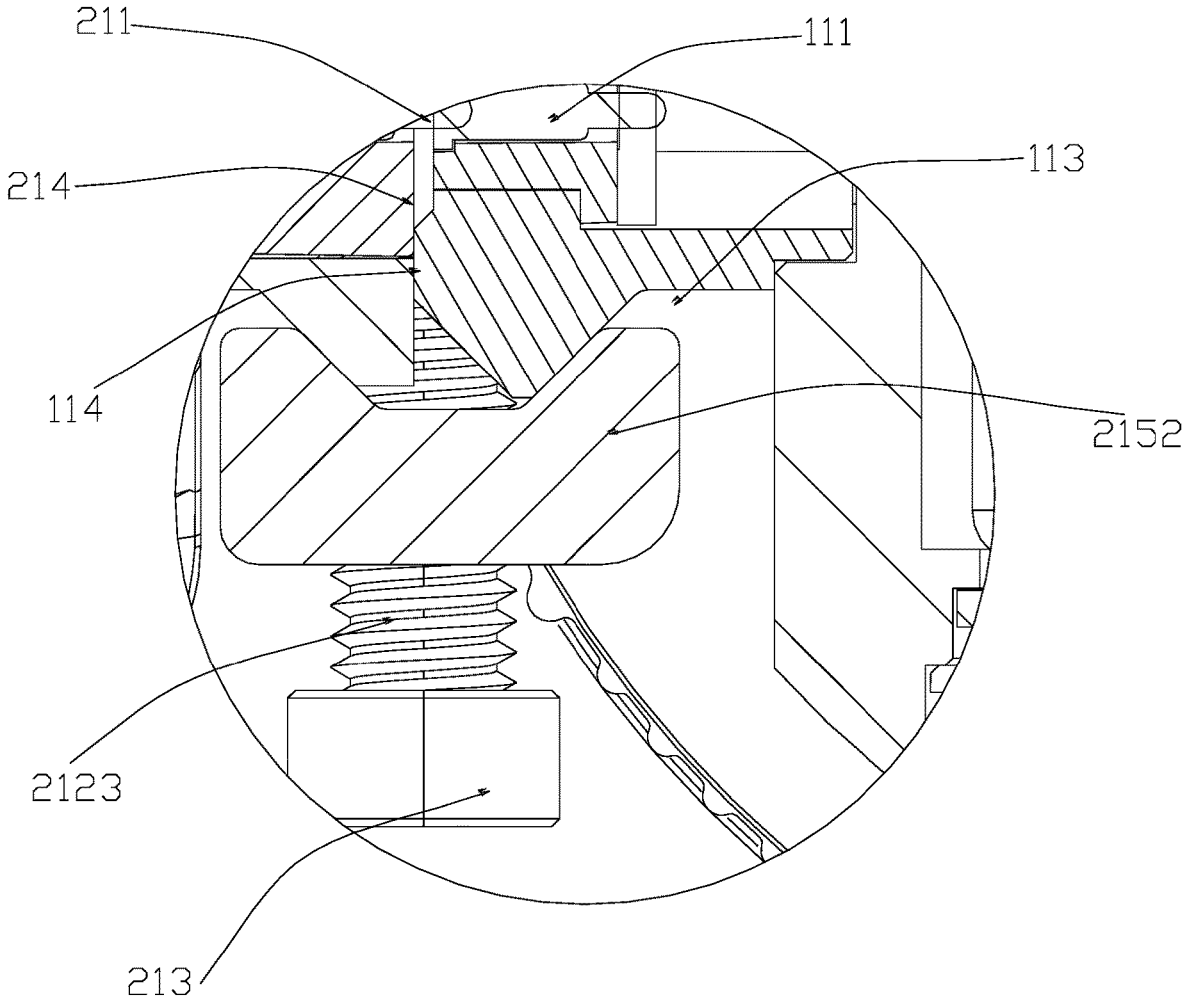
FIG. 8 is an enlarged diagram of circle C in FIG. 7.

As shown in FIG. 4, FIG. 6, and FIG. 8, in this embodiment, an abutment platform 114 is convexly arranged at an edge of the first electrical connection portion 111. An abutment surface 214 is arranged at an edge of the second electrical connection portion 211. The abutment platform 114 abuts against the abutment surface 214. An accommodating space is formed between an inner wall of the abutment platform 114 and the abutment surface 214. The accommodating space is configured to hermetically accommodate the first electrical connection portion 111 and the second electrical connection portion 211. Based on the setting of the above structure, during use, the first clamping block 2151 and the second clamping block 2152 are respectively clamped to the upper and lower clamping slots of the first connector 11, and the second electrical connection portion 211 is electrically connected to the first electrical connection portion 111. At this time, the abutment platform 114 abuts against the abutment surface 214, so that the accommodating space is formed between the inner wall of the abutment platform 114 and the abutment surface 214. The accommodating space can accommodate and protect the first electrical connection portion 111 and the second electrical connection portion 211, so that the stability of the product can be improved; external water, dust, or other impurities can be prevented from polluting the first electrical connection portion 111 and the second electrical connection portion 211; and the service life of the product is prolonged.

Figure 7:
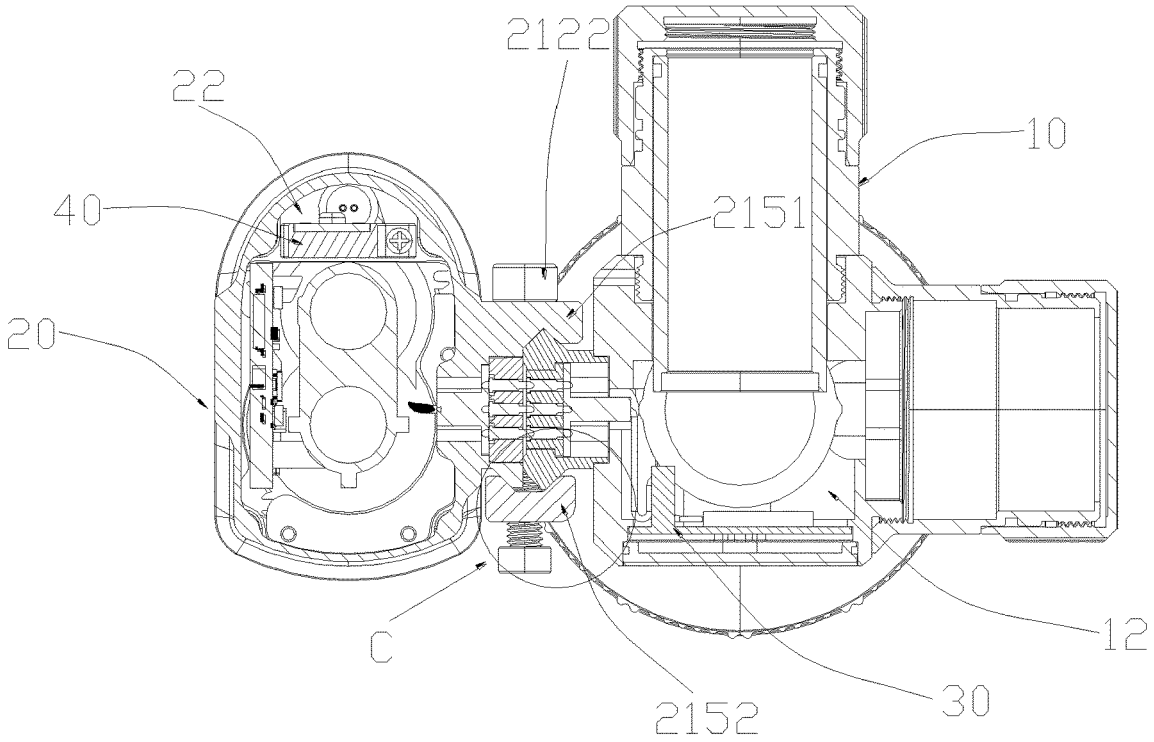
FIG. 7 is a sectional diagram with a first accessory according to the present disclosure.

As shown in FIG. 7, in this embodiment, the sighting module housing 10 is provided with a first accommodating cavity 12. A first control circuit board 30 is arranged in the first accommodating cavity 12. The first electrical connection portion 111 is electrically connected to the first control circuit board 30. Based on the setting of the above structure, the first control circuit board 30 is arranged in the first accommodating cavity 12, so that the first control circuit board 30 can be effectively protected; the stability of the sighting device product can be improved; and the service life of the product can be prolonged. The first electrical connection portion 111 is electrically connected to the first control circuit board 30, so that electrical signal transmission between the first electrical connection portion 111 and the first control circuit board 30 can be achieved.

As shown in FIG. 7, in this embodiment, the accessory housing 20 is provided with a second accommodating cavity 22. A second control circuit board 40 is arranged in the second accommodating cavity 22. The second electrical connection portion 211 is electrically connected to the second control circuit board 40. Based on the setting of the above structure, the second control circuit board 40 is arranged in the second accommodating cavity 22, so that the second control circuit board 40 can be effectively protected; the stability of the accessory can be improved; and the service life of the product can be prolonged. The second electrical connection portion 211 is electrically connected to the second control circuit board 40, so that electrical signal transmission between the second electrical connection portion 211 and the second control circuit board 40 can be achieved.

Figure 2:
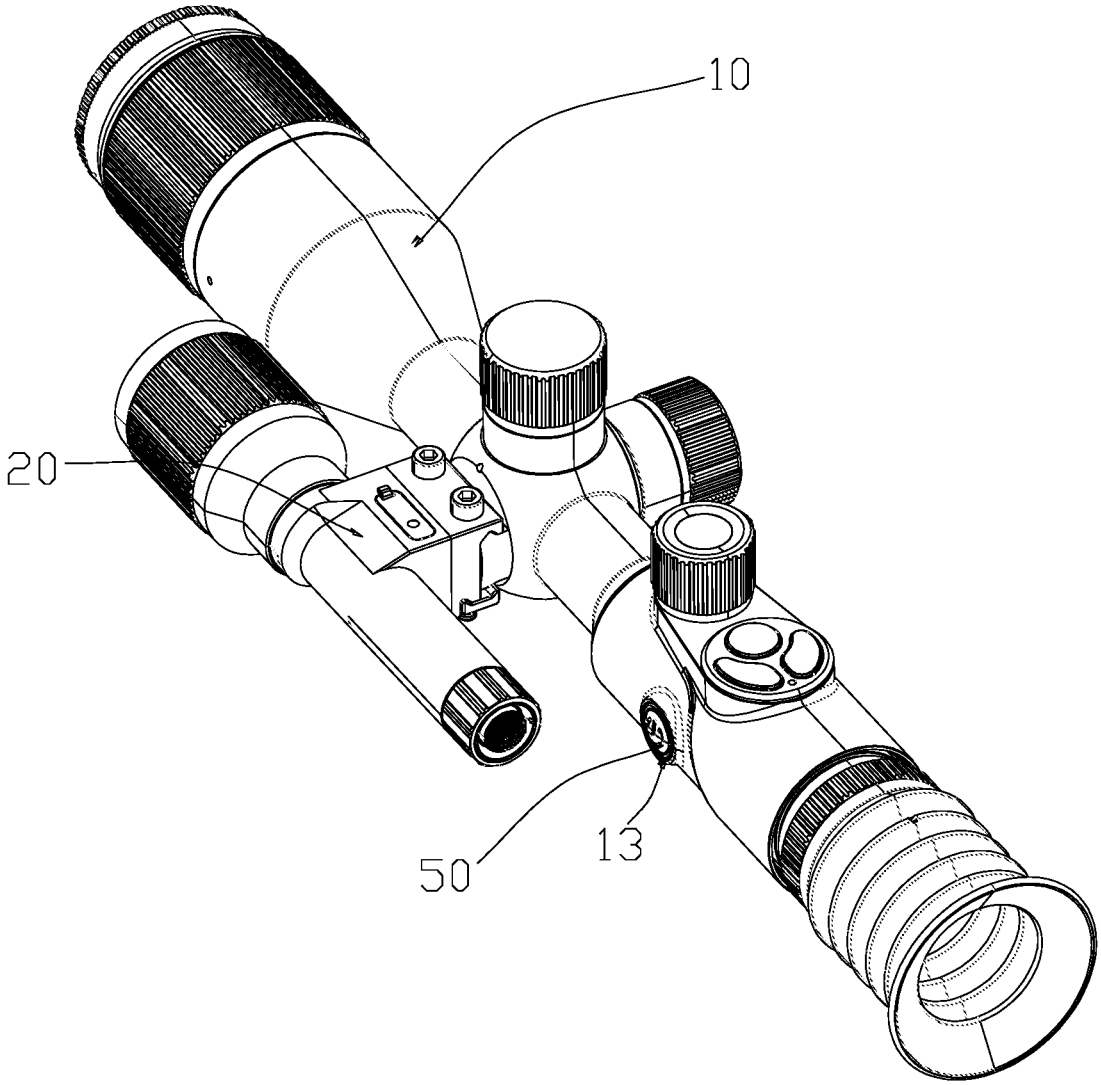
FIG. 2 is a schematic diagram of an entire structure with a second accessory according to the present disclosure.
Figure 3:
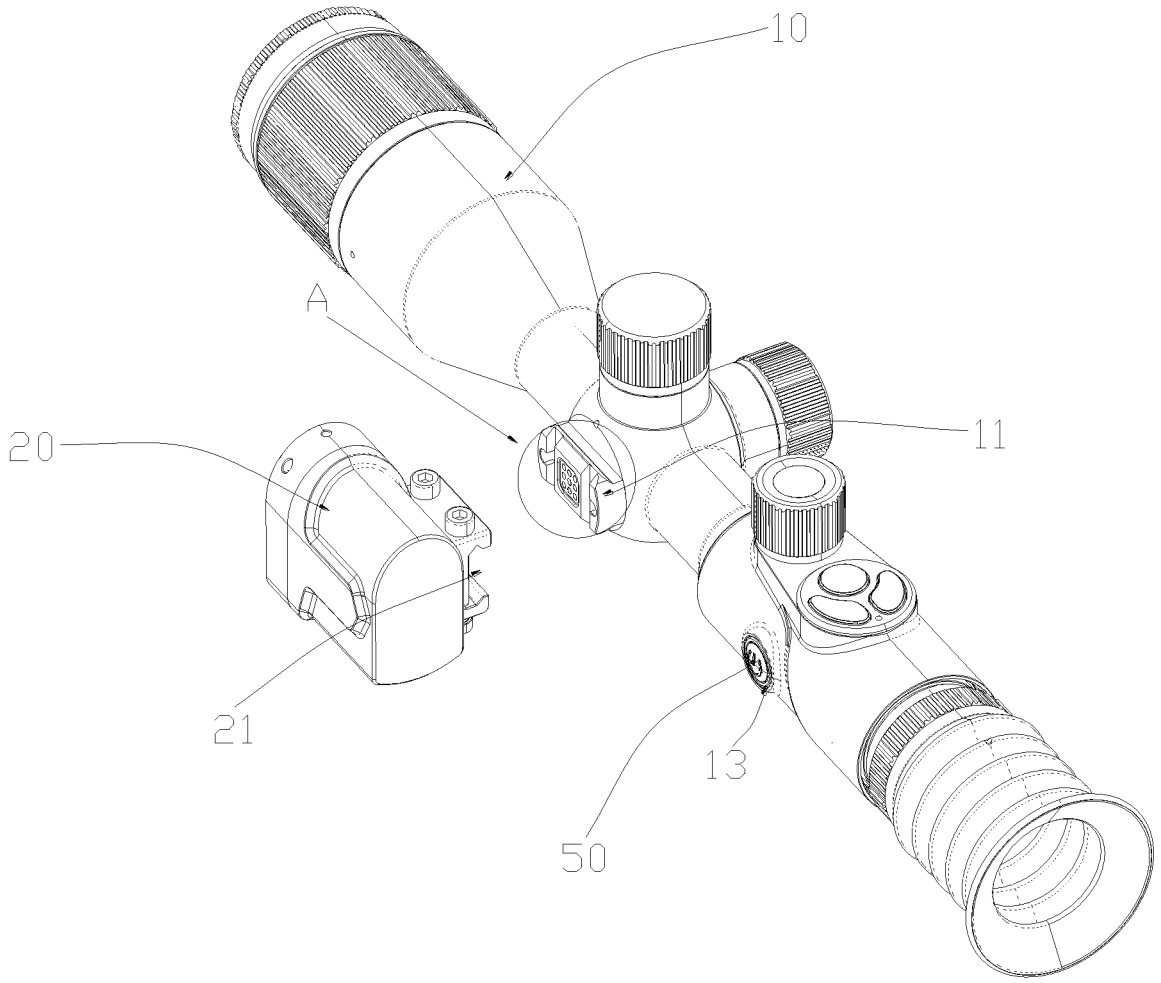
FIG. 3 is a schematic diagram of an exploded structure with a first accessory in a first view according to the present disclosure.

As shown in FIG. 1 to FIG. 2, in this embodiment, the sighting device with the quick-release accessory further includes a button 50. A button hole 13 is formed in a surface of the sighting module housing 10. The button 50 is plugged to the button hole 13. The button 50 is configured to trigger an electrical contact connected to the first control circuit board 30. Based on the setting of the above structure, during use, the user can turn on or turn off a circuit in the sighting device by pushing the button 50, thereby controlling the sighting device and facilitating operations of the user.

Referring to FIG. 1 to FIG. 11, a sighting device with an assembling-and-disassembling-facilitated accessory includes: a sighting module housing 10, wherein a first connector 11 is arranged on one side of the sighting module housing 10; a first electrical connection portion 111 is arranged on one side of the first connector 11 facing away from the sighting module housing 10; the first connector 11 is configured to allow detachable connection of a second connector 21 on an accessory housing 20; and the first electrical connection portion 111 is configured to allow electrical connection of a second electrical connection portion 211 on the second connector 21.

During use, the second connector 21 on the accessory housing 20 is connected to the first connector 11, so that the accessory housing 20 is connected to the sighting module housing 10. Meanwhile, the second electrical connection portion 211 on the second connector 21 is electrically connected to the first electrical connection portion 111, which achieves electrical connection between the accessory and the sighting device. Based on the simple structural setting, the accessory is connected to the sighting device, so that the sighting device can realize different functions by being connected to different lens accessories, improves the product suitability, and is convenient to use.

As shown in FIG. 4, FIG. 6, and FIG. 9, in this embodiment, the first connector 11 is provided with a clamping slot 113, and the clamping slot 113 is configured to clamp a clamping block 215 on the second connector 21. Based on the setting of the above structure, during use, the clamping block 215 on the second connector 21 cooperates with the clamping slot 113. On the one hand, mounting and removal are facilitated, so that a user can conveniently replace the accessory; and on the other hand, the stability of a product can also be improved, so that the accessory is more stably connected to the sighting device.

As shown in FIG. 4, in this embodiment, two plugging slots 112 are further formed in one side of the first connector 11 facing away from the sighting module housing 10. The two plugging slots 112 are symmetrically arranged on two sides of the first electrical connection portion 111. The plugging slots 112 correspond to rod bodies 2121 on the second connector 21, and the plugging slots 112 are configured to accommodate the rod bodies 2121. Based on the setting of the above structure, during use, the first clamping block 2151 and the second clamping block 2152 are respectively clamped to the two clamping slots 113 on upper and lower sides of the first connector 11. At this time, the second electrical connection portion 211 on the second connector 21 is electrically connected to the first electrical connection portion 111. The rod bodies on the second connector 21 can be accommodated in the plugging slots 112. On the one hand, the stability of connection between the first connector 11 and the second connector 21 can be further improved, and a direct contact area between the first connector 11 and the second connector 21 can be enlarged. On the other hand, positioning and guide effects can also be achieved. When the rod bodies of the sliding rods 212 are accommodated in the plugging slots 112, it means that the accessory is mounted to the sighting device according to a right method, which can prevent a damage to the product caused by mis-installation by the user and improve the use experience of the user.

As shown in FIG. 4, FIG. 6, and FIG. 8, in this embodiment, an abutment platform 114 is convexly arranged at an edge of the first electrical connection portion 111. The abutment platform 114 is configured to abut against an abutment surface 214 at an edge of the second electrical connection portion 211. An accommodating space is formed between an inner wall of the abutment platform 114 and the abutment surface 214. The accommodating space is configured to hermetically accommodate the first electrical connection portion 111 and the second electrical connection portion 211. Based on the setting of the above structure, during use, the first clamping block 2151 and the second clamping block 2152 are respectively clamped to the clamping slots 113 on the upper and lower sides of the second connector 21, and the second electrical connection portion 211 on the second connector 21 is electrically connected to the first electrical connection portion 111. At this time, the abutment platform 114 abuts against the abutment surface 214 at the edge of the second electrical connection portion 211, so that the accommodating space is formed between the inner wall of the abutment platform 114 and the abutment surface 214. The accommodating space can accommodate and protect the first electrical connection portion 111 and the second electrical connection portion 211, so that the stability of the product can be improved; external water, dust, or other impurities can be prevented from polluting the first electrical connection portion 111 and the second electrical connection portion 211; and the service life of the product is prolonged.

As shown in FIG. 7, in this embodiment, the sighting module housing 10 is provided with a first accommodating cavity 12. A first control circuit board 30 is arranged in the first accommodating cavity 12. The first electrical connection portion 111 is electrically connected to the first control circuit board 30. Based on the setting of the above structure, the first control circuit board 30 is arranged in the first accommodating cavity 12, so that the first control circuit board 30 can be effectively protected; the stability of the sighting device product can be improved; and the service life of the product can be prolonged. The first electrical connection portion 111 is electrically connected to the first control circuit board 30, so that electrical signal transmission between the first electrical connection portion 111 and the first control circuit board 30 can be achieved.

As shown in FIG. 1 to FIG. 2, in this embodiment, the sighting device with the quick-release accessory further includes a button 50. A button hole 13 is formed in a surface of the sighting module housing 10. The button 50 is plugged to the button hole 13. The button 50 is configured to trigger an electrical contact connected to the first control circuit board 30. Based on the setting of the above structure, during use, the user can turn on or turn off a circuit in the sighting device by pushing the button 50, thereby controlling the sighting device and facilitating operations of the user.

Referring to FIG. 1 to FIG. 11, an accessory of a sighting device includes:

an accessory housing 20, wherein a second connector 21 is arranged on one side of the accessory housing 20; the second connector 21 is configured to be detachably connected to a first connector 11 on a sighting module housing 10, so that the accessory housing 20 is connected to the sighting module housing 10; a second electrical connection portion 211 is arranged on one side of the second connector 21 facing away from the accessory housing 20; and the second electrical connection portion 211 is configured to be electrically connected to the first electrical connection portion 111 on the first connector 11.

Based on the setting of the above structure, during use, the second connector 21 is connected to the first connector 11 on the sighting module housing 10, so that the accessory housing 20 is connected to the sighting module housing 10. Meanwhile, the second electrical connection portion 211 is electrically connected to the first electrical connection portion 111 on the first connector 11, which achieves electrical connection between the accessory and the sighting device. Based on the simple structural setting, the accessory is connected to the sighting device, so that the sighting device can realize different functions by being connected to different lens accessories, improves the product suitability, and is convenient to use.

As shown in FIG. 4, FIG. 6, and FIG. 9, in this embodiment, the second connector 21 is provided with a clamping block 215, and the clamping block 215 is configured to be clamped to a clamping slot 113 on the first connector 11. Based on the setting of the above structure, during use, the clamping block 215 cooperates with the clamping slots 113 on two sides of the first connector 11. On the one hand, mounting and removal are facilitated, so that a user can conveniently replace the accessory; and on the other hand, the stability of a product can also be improved, so that the accessory is more stably connected to the sighting device.

As shown in FIG. 6 and FIG. 9, in this embodiment, the second connector 21 further includes two sliding rods 212 and stop nuts 213. The clamping block 215 includes a first clamping block 2151 and a second clamping block 2152. The second clamping block 2152 is provided with threaded holes 2153. A first end of each sliding rod 212 is connected to the first clamping block 2151, and a second end of the sliding rod 212 is provided with a thread portion 2121. The stop nuts 213 and the threaded holes 2153 are both in threaded connection to the thread portions 2121. The stop nuts 213 abut against the second clamping block 2152. Based on the setting of the above structure, during use, the threaded portions at the second ends of the sliding rods 212 are at least partially in threaded connection to the threaded holes 2153, and the stop nuts 213 are in threaded connection to tail ends of the threaded portions. The stop nuts 213 are screwed to move along the sliding rods 212, which can adjust a distance between the first clamping block 2151 and the second clamping block 2152, and abut against a surface of the second clamping block 2152, which can effectively limit the second clamping block 2152, to prevent the second clamping block from being separated from the sliding rods 212, so that the first clamping block and the second clamping block 2152 can be stably clamped into the clamping slot 113, and the stability of the product can be improved. Furthermore, the threaded portions are in threaded connection to the threaded holes 2153, so that the second clamping block 2152 can be stably connected to the sliding rods 212 to fix the distance between the first clamping block 2151 and the second clamping block 2152, and the first clamping block 2151 and the second clamping block 2152 are stably clamped to the clamping slot 113.

As shown in FIG. 6 and FIG. 9, in this embodiment, the first ends of the sliding rods 212 are fixedly provided with limiting portions 2122. The first clamping block 2151 is provided with through holes 2154. The through holes 2154 correspond to the threaded holes 2153. The second ends of the sliding rods 212 pass through the through holes 2154. The threaded portions 2121 are in threaded connection to the threaded holes 2153. The limiting portions 2122 abut against one end of the first clamping block 2151 facing away from the second clamping block 2152. Based on the setting of the above structure, the first ends of the sliding rods 212 are provided with the limiting portions 2122 which can cooperate with the through holes 2154 in the first clamping block 2151 to facilitate mounting by the user. Specifically, during mounting, the second ends of the sliding rods 212 pass through the through holes 2154; the limiting portions 2122 abut against the first clamping block 2151; the threaded portions are in threaded connection to the threaded holes 2153 and the stop nuts 213; and the stop nuts 213 abut against the second clamping block 2152, so that the first clamping block 2151 and the second clamping block 2152 can be effectively fixed, and the stability of the product can be improved. The stop nuts 213 move along the sliding rods 212, which can adjust a distance between the first clamping block 2151 and the second clamping block 2152, and abut against a surface of the second clamping block 2152, which can effectively limit the second clamping block 2152, to prevent the second clamping block 2152 from being separated from the sliding rods 212, so that the first clamping block 2151 and the second clamping block 2152 can be stably clamped into the clamping slot 113, and the stability of the product can be improved.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A sighting device with a quick-release accessory, comprising:

a sighting module comprising a sighting module housing, wherein a first connector is arranged on one side of the sighting module housing, and a first electrical connection portion is arranged on one side of the first connector facing away from the sighting module housing; and an accessory comprising an accessory housing, wherein a second connector is arranged on one side of the accessory housing; the second connector is detachably connected to the first connector, so that the accessory housing is connected to the sighting module housing; a second electrical connection portion is arranged on one side of the second connector facing away from the accessory housing; and the second electrical connection portion is electrically connected to the first electrical connection portion;

wherein the first connector is provided with a clamping slot; the second connector is provided with a clamping block; and the clamping block is clamped to the clamping slot;

wherein the second connector further comprises two sliding rods and stop nuts; the clamping block comprises a first clamping block and a second clamping block; the second clamping block is provided with threaded holes; a first end of each sliding rod is connected to the first clamping block, and a second end of the sliding rod is provided with a thread portion; the stop nuts and the threaded holes are both in threaded connection to the thread portions; and the stop nuts abut against the second clamping block.

2. The sighting device with the quick-release accessory according to claim 1, wherein the first ends of the sliding rods are fixedly provided with limiting portions; the first clamping block is provided with through holes; the through holes correspond to the threaded holes; the second ends of the sliding rods pass through the through holes and the threaded holes; and the limiting portions abut against one end of the first clamping block facing away from the second clamping block.

3. The sighting device with the quick-release accessory according to claim 2, wherein the two sliding rods are symmetrically arranged on two sides of the second electrical connection portion.

4. The sighting device with the quick-release accessory according to claim 3, wherein two plugging slots are further formed in one side of the first connector facing away from the sighting module housing; the two plugging slots are symmetrically arranged on two sides of the first electrical connection portion; the plugging slots correspond to rod bodies; and the plugging slots are configured to accommodate the rod bodies.

5. The sighting device with the quick-release accessory according to claim 3, wherein an abutment platform is convexly arranged at an edge of the first electrical connection portion; an abutment surface is arranged at an edge of the second electrical connection portion; the abutment platform abuts against the abutment surface; an accommodating space is formed between an inner wall of the abutment platform and the abutment surface; and the accommodating space is configured to hermetically accommodate the first electrical connection portion and the second electrical connection portion.

6. The sighting device with the quick-release accessory according to claim 1, wherein the sighting module housing is provided with a first accommodating cavity; a first control circuit board is arranged in the first accommodating cavity; and the first electrical connection portion is electrically connected to the first control circuit board.

7. The sighting device with the quick-release accessory according to claim 6, wherein the accessory housing is provided with a second accommodating cavity; a second control circuit board is arranged in the second accommodating cavity; and the second electrical connection portion is electrically connected to the second control circuit board.

8. The sighting device with the quick-release accessory according to claim 6, further comprising a button, wherein a button hole is formed in a surface of the sighting module housing; the button is plugged to the button hole; and the button is configured to trigger an electrical contact connected to the first control circuit board.

9. The sighting device with the quick-release accessory according to claim 1, wherein the accessory comprises a night-vision device.

10. The sighting device with the quick-release accessory according to claim 1, wherein the accessory comprises a distance measuring equipment.

11. A sighting module of a sighting device comprising a sighting module housing, wherein a first connector is arranged on one side of the sighting module housing, and a first electrical connection portion is arranged on the first connector, the first connector is configured to detachably connected a second connector of an accessory, and when the first connector is connected to the second connector, the first electrical connection portion is electrically connected to a second electrical connection portion of the accessory;

wherein an abutment platform is convexly arranged at an edge of the first electrical connection portion.

12. A sighting device with a quick-release accessory, comprising:

a sighting module comprising a sighting module housing, wherein a first connector is arranged on one side of the sighting module housing, and a first electrical connection portion is arranged on one side of the first connector facing away from the sighting module housing; and an accessory comprising an accessory housing, wherein a second connector is arranged on one side of the accessory housing; the second connector is detachably connected to the first connector, so that the accessory housing is connected to the sighting module housing; a second electrical connection portion is arranged on one side of the second connector facing away from the accessory housing; and the second electrical connection portion is electrically connected to the first electrical connection portion;

wherein an abutment platform is convexly arranged at an edge of the first electrical connection portion; an abutment surface is arranged at an edge of the second electrical connection portion; the abutment platform abuts against the abutment surface; an accommodating space is formed between an inner wall of the abutment platform and the abutment surface; and the accommodating space is configured to hermetically accommodate the first electrical connection portion and the second electrical connection portion.

13. The sighting device with the quick-release accessory according to claim 12, wherein the sighting module housing is provided with a first accommodating cavity; a first control circuit board is arranged in the first accommodating cavity; and the first electrical connection portion is electrically connected to the first control circuit board.

14. The sighting device with the quick-release accessory according to claim 13, wherein the accessory housing is provided with a second accommodating cavity; a second control circuit board is arranged in the second accommodating cavity; and the second electrical connection portion is electrically connected to the second control circuit board.

15. The sighting device with the quick-release accessory according to claim 12, wherein the second electrical connection portion comprises a plurality of pins arranged in an array.

16. The sighting device with the quick-release accessory according to claim 1, wherein the first clamping block defines a V-shaped groove, the second clamping block defines a trapezoid groove.

17. The sighting device with the quick-release accessory according to claim 1, wherein the second electrical connection portion comprises a plurality of pins arranged in an array.

18. The sighting device with the quick-release accessory according to claim 1, wherein the clamping block is coupled in the clamping slot along a direction along an optical axis of the sighting module.

* * * * *